US005823109A

United States Patent [19]

Hummel et al.

[11] Patent Number: 5,823,109

[45] Date of Patent: Oct. 20, 1998

[54] OFFSET PRINTING DEVICE FOR A ROTARY MCHINE PRINTING MACHINES

[75] Inventors: Peter Hummel, Offenbach; Robert Ortner, Alzenau, both of Germany

[73] Assignee: MAN Roland Druckmaschinen AG, Germany

[21] Appl. No.: 880,121

[22] Filed: Jun. 20, 1997

[30] Foreign Application Priority Data

Jun. 22, 1996 [DE] Germany ..... 196 25 029.3

[51] Int. Cl.[6] ..... B41F 31/06; B41F 31/10; B41F 31/14

[52] U.S. Cl. ..... 101/350.4; 101/148

[58] Field of Search ..... 101/350.4, 350.3, 101/350.2, 350.1, 349.1, 352.06, 147, 148, DIG. 38; 118/258, 259

[56] References Cited

U.S. PATENT DOCUMENTS

| | | | |
|---|---|---|---|
| 3,467,008 | 9/1969 | Domotor | 101/142 |
| 4,397,236 | 8/1983 | Greiner et al. . | |
| 5,265,527 | 11/1993 | Tedford | 101/148 |
| 5,345,865 | 9/1994 | Kemp | 101/349 |

FOREIGN PATENT DOCUMENTS

| | | |
|---|---|---|
| 1808909 | 3/1974 | Germany . |
| 2659557 | 7/1978 | Germany . |
| 2658362 | 11/1980 | Germany . |
| 3034644 | 10/1982 | Germany . |
| 4423286 | 1/1996 | Germany . |

*Primary Examiner*—J. Reed Fisher
*Attorney, Agent, or Firm*—Leydig, Voit & Mayer, Ltd.

[57] ABSTRACT

An offset printing system includes an improved inking unit for applying ink to a rotatable plate cylinder, wherein the inking unit appreciably reduces the production of contaminants. In particular, the inking unit one or more ink application rollers that adjacently contact the plate cylinder. A series of rollers are in ink communication with these application rollers, including at least one inking roller in direct contact with the ink application rollers, and at least one inking roller in indirect inking communication with the ink application rollers. The inking rollers are driven in a positively locking manner and which are drivable at a peripheral speed that differs from the peripheral speed of the plate cylinder, and the inking roller furthest from the plate cylinder is driven with the greatest peripheral speed differential relative to the plate cylinder. This peripheral speed differential between rollers results in a relative slippage and wiping effect which advantageously reduces the effect of contaminants.

9 Claims, 2 Drawing Sheets

OFFSET PRINTING DEVICE FOR A ROTARY MCHINE PRINTING MACHINES

FIELD OF THE INVENTION

The present invention generally relates to an offset printing device for rotary printing machines, and more particularly relates to an inking roller arrangement wherein contacting rollers are driven at different peripheral speeds in order to reduce contaminants.

BACKGROUND OF THE INVENTION

A conventional offset printing device is disclosed in German patent publication DE 44 23 286 Al, in which a plate cylinder carries a printing form suitable for offset printing without dampening solution, a process known as dry flatbed printing. The printing form is inked with an appropriate printing ink. In order to eliminate or to prevent contaminants, which are undesirably reproduced in the printed image on the material being printed, an additional application roller can be thrown onto and off from the printing form, independently of the ink rollers present. The additional application roller can be switched between first and second operating positions. In the first operating position, the application roller is thrown onto the printing form and is drivable at a peripheral speed which differs from a peripheral speed of the plate cylinder. In the second operating position, the application roller is thrown off from the printing form, but is integrated into the inking unit.

A wet offset printing device is known from German patent publication DE-B 18 08 909. In order to remove contaminants from the printing form, at least one application roller of the damping or inking unit can be driven at a different peripheral speed than the peripheral speed of the plate cylinder, by a gear train in a positively locking manner. This mode of operation is not suitable for a dry offset plate, which has a non-metallic surface coating, since the dry flatbed printing plate is less wear-resistant than a printing plate for offset printing which transfers damping medium. Furthermore, the contaminants in the inking unit or the damping unit are transported further to a roller, from which accumulated contaminants must be regularly removed.

OBJECTS AND SUMMARY OF THE INVENTION

An object of the invention is to provide an offset printing device which minimizes an effect of contaminants occurring during wet or dry offset printing.

By means of the invention, the effects of contaminants is appreciably reduced by providing an inking unit which has a plurality of positively driven inking rollers that rotate with a peripheral speeds different than a peripheral speed of the plate cylinder, and wherein the ink application rollers themselves (i.e., the rollers directly contacting the plate cylinder) have no positive drive.

In keeping with the invention, another embodiment provides that the inking rollers are positively driven in a stepwise manner at respective peripheral speeds which deviate from one another and from the peripheral speed of the plate cylinder. Preferably the inking rollers which are mounted closer to the plate cylinder are driven with a lower speed differential, and the inking rollers mounted further from the plate cylinder are operated with a greater speed differential relative to the peripheral speed of the plate cylinder). As a result, within the inking unit, a differential speed gradient exists among the positively driven inking rollers. This gradient, for example, in such that an ink application roller adjacent to the plate cylinder is has a speed differential of 2%, and an inking roller in the roller train which is furthest removed from the plate cylinder, for example adjacent to the ink ductor roller, is has a speed differential of 10% (in relation to the peripheral speed of the plate cylinder). In this arrangement, the positively driven inking rollers, are preferably rotated at a lower peripheral speed with respect to the peripheral speed of the plate cylinder. Alternatively, however a higher differential speed of the inking rollers in relation to the peripheral speed of the plate cylinder is within the scope of the invention.

As a result of the differential speed gradient among the inking unit rollers in relation to the peripheral speed of the plate cylinder, a rotational slip is formed at each roller contact point of the inking unit. The rotational slip is formed, in particular at the ink application rollers, by two contact points: a first slip occurring in relation to the plate cylinder; and a second slip occurring in relation to the adjacent, positively driven inking unit roller. The rotational slip creates a "wiping effect" which reduces the contaminants (paper dust, hickeys etc.) occurring in the inking unit. In particular, contaminants in the contact points are destroyed or noticeably reduced in size, so that negative effects on the print quality fail to appear. A need for a "dirt catcher roller", as is known in the prior art, is thereby eliminated. The inking unit needs less frequent washing as a result, saving detergent and water. Furthermore, this reduces a need to replace the plastic-coated inking unit rollers, which are susceptible to the build-up of contaminants.

In order to further enhance the contaminant-reducing effect, the positively rotating inking rollers may be additionally driven into axially oscillate in an appropriate manner generally known in the art. The oscillating motion is also frictionally transmitted to the non-driven inking unit rollers. This produces, in addition to the rotational slip, an axial slip within each roller contact point. As a result of this additional axial slip, contaminants are additionally reduced in size and or the production of contaminants may be prevented altogether. This embodiment of the offset printing device is suitable for waterless offset printing (dry flatbed printing) and also for wet offset printing using a damping unit.

BRIEF DESCRIPTION OF THE DRAWINGS

These and other features and advantages of the invention will be more readily apparent upon reading the following description of a preferred exemplified embodiment of the invention and upon reference to the accompanying drawings wherein.

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

DETAILED DESCRIPTION OF THE DRAWINGS

Figure 1:
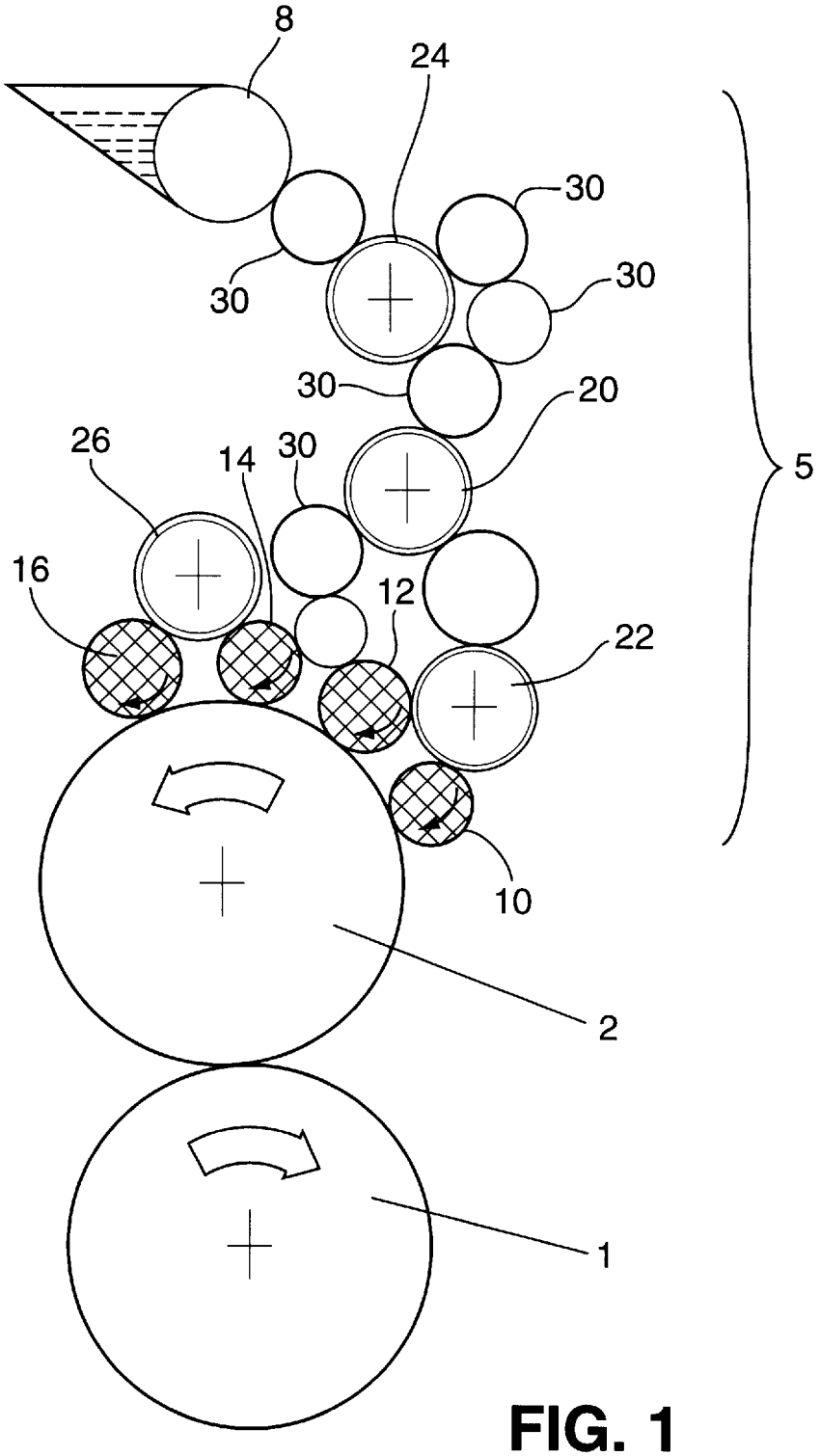
FIG. 1 is a side schematic view of a printing unit for dry offset printing.

Referring now more particularly to FIG. 1 of the drawings, there is shown an illustrative printing unit 5 according to the invention. The printing unit 5 comprises a rubber blanket cylinder 1 and an associated plate cylinder 2, which carries a dry flatbed printing plate for dry or waterless offset printing. To supply ink to the plate cylinder 2, an inking unit 5 is provided includes four positively driven ink application rollers 10, 12, 14 and 16 mounted adjacent to the plate cylinder 2 in a manner by which they can be thrown on and off of contact with the plate cylinder 2. The ink application rollers 10, 12, 14 and 16 are in ink communication with a conventional ink fountain and ductor roller 8 via a plurality of inking rollers 20, 22, 24, 26 and a plurality of relatively smaller diameter ink transfer rollers 30.

The ink application rollers 10, 12, 14 and 16 are in contact with drivable inking rollers 20, 22, 24 and 26 which, in the present example, are designed as ink distributor rollers. In particular, as illustrated in FIG. 1, the inking rollers 26 and 22 are in direct contact with the ink application rollers 14, 16 and 12, 10, respectively. Accordingly, the inking rollers 22 and 26 are termed direct-contact inking rollers herein. The inking rollers 20 and 24 are positioned further away in the inking unit 5 from the plate cylinder 2, and these inking rollers 20, 24 are not in direct contact with the ink application rollers, but rather are in indirect inking communication with the application rollers via the intermediate transfer rollers 30. The inking rollers 20, 24 are referred to herein as indirect-contact rollers.

The inking rollers 20, 22, 24 and 26 are positively driven preferably through an appropriate gear coupling to the plate cylinder 2. Alternatively, each of the inking rollers 20, 22, 24 and 26 can be driven by an individual drive or else a drive which is common but decoupled from the plate cylinder 2.

In accordance with the invention, in order to reduce the effect of contaminants, the inking rollers which are positioned farther away from the plate cylinder, i.e., the inking rollers first encountered by the ink being transferred to the printing plate, are operated at a greater peripheral speed differential relative to the plate cylinder than the inking rollers which are located more closely in inking communication to the plate cylinder. Specifically, the inking roller 24 which is arranged furthest away from the plate cylinder 2 is, driven with a greater difference between its peripheral speed and the peripheral speed of the plate cylinder 2 than the inking rollers 22 and 26 which are arranged closer to the plate cylinder 2. Preferably, the inking roller 20, which is arranged intermediately in the roller train of the inking unit 5, is positively operated with a differential speed lying in between the speed of the furthest inking roller 24 and the direct-contact inking rollers 26 and 22. A preferred differential gradient is selected in steps such that: (a) inking roller 22 is driven at a 2% differential speed with respect to the speed of the plate cylinder 2; (b) inking roller 20 is driven at a 4% differential speed with respect to the speed of the plate cylinder 2; and (c) inking roller 24 is driven at a 6% differential speed with respect to the speed of the plate cylinder 2. These differentials may be either faster or slower than the peripheral speed of the plate cylinder 2. The inking roller 26 may be positively driven at either a 0% or 2% speed differential speed with respect to the speed of the plate cylinder 2.

For further enhancing contaminant reduction, the inking rollers 20, 22, 24 and 26 are also oscillated. The ink application rollers 10, 12, 14 and 16 are mounted in an appropriate manner so that oscillating movement of the direct-contact inking rollers 26 and 22 causes frictionally-sliding contact against the adjacent ink application rollers 10, 12, 14 and 16. The transfer rollers 30 of the inking unit 5 located adjacent to the ink application rollers can also be subjected to the oscillating frictionally-sliding contact. At the contact points, in particular between plate cylinder 2 and the ink application rollers 10, 12, 14 and 16, the contaminants (dirt particles, dust, paper and ink particles) are reduced.

As a result of the higher differential speeds in the case of the indirect-contact inking rollers 20 and 24 which are arranged further away from the plate cylinder 2, the penetration forward of relatively small contaminants within the roller train is prevented. In the case of contaminants which are greater, the contaminants which have already been reduced in size at the contact points of the direct-contact inking rollers 22 and 26 are additionally reduced in size at contact points which are further away.

Figure 2:
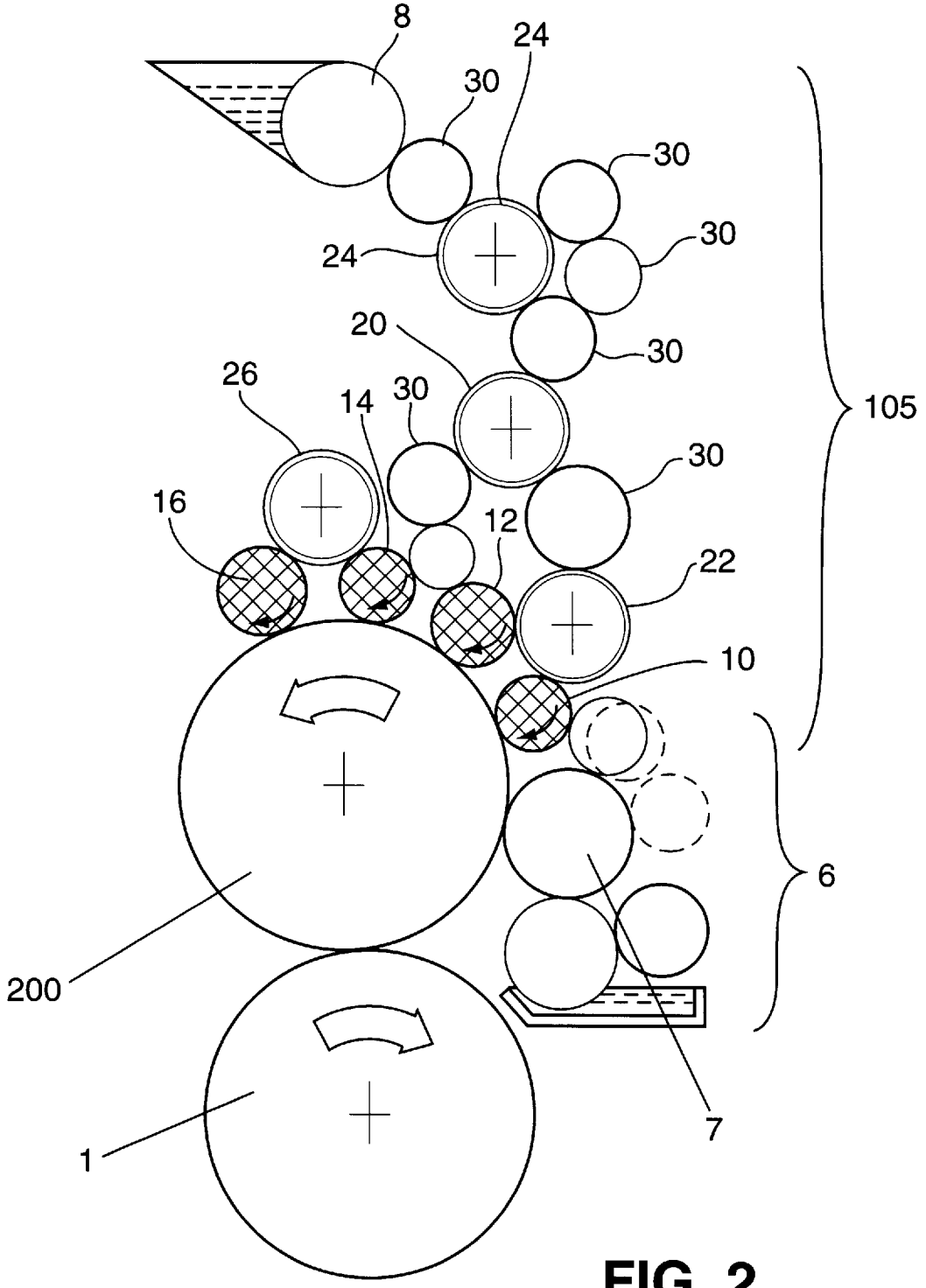
FIG. 2 is a side schematic view of a printing unit for wet offset printing.

Referring now to FIG. 2, there is shown an alternative embodiment of a printing unit 105 wherein elements similar to the embodiment of FIG. 1 have been given like reference numbers. The printing unit 105 also include a rubber blanket cylinder 1, and an inking unit 5. However, the embodiment of FIG. 2 has a plate cylinder 200 adapted for wet offset printing, and accordingly, the printing unit 105 additionally includes a damping unit 6. This damping unit 6 has a damping solution application roller 7 which can be movably thrown on and off of the plate cylinder 2. The damping solution application roller 7 is coupled in a known manner to a damping solution ductor which dips into a damping solution container. A metering roller is mounted to roll against the damping solution ductor. A bridging roller rolling adjacent the damping solution application roller 7 may be mounted to selectively roll against the first-encountered ink application roller 10 as viewed from the direction of rotation of the plate cylinder 200. As required, an optional rider roller can be mounted to roll against the damping solution application roller 7.

The inking unit 105 also includes inking rollers 20, 22, 24 and 26 which are positively driven in a rotational manner. As in the previously described embodiment, these inking rollers 20, 22, 24, and 26 preferably also have an oscillating drive of a known type. Due to this oscillating drive, the transfer rollers 30 and ink application rollers 10, 12, 14 and 16 which are adjacent to the inking rollers 20, 22, 24 and 26 are in frictionally-sliding contact with those respective inking rollers. In this case, the inking roller 24, as the positively drivable roller which is furthest from the plate cylinder, is operated with the greatest difference in peripheral speed in relation to the plate cylinder peripheral speed.

Preferably, the inking rollers in this embodiment are also driven at a differential speed gradient relative to the peripheral speed of the plate cylinder 200. An exemplary speed differential is such that: (a) inking roller 26 is driven at a 10% difference; (b) inking roller 20 is driven at a 8% difference; (c) inking roller 22 is driven at a 4% difference; and (d) inking roller 26 is driven at a 2% difference in relation to the peripheral speed of the plate cylinder 2.

What is claimed is:

1. An offset printing device for a rotary printing machine comprising:

a plate cylinder carrying a printing plate; and an inking unit for applying printing ink to a printing plate, including:

at least one ink application roller rotatably mounted in adjacent contact with the plate cylinder;

at least one direct-contact inking roller in direct contact with the ink application roller, the direct-contact inking roller being driven at a peripheral speed different than a peripheral speed of the plate cylinder;

at least one indirect-contact inking roller in indirect ink communication with the application roller, the indirect-contact inking roller being driven at a peripheral speed different than the peripheral speed of the plate cylinder;

wherein the indirect-contact inking roller is driven at greater difference in peripheral speed than the direct-contact inking roller relative to the plate cylinder.

2. The offset printing device according to claim 1, further comprising means for axially oscillating at least one of the inking rollers.

3. The offset printing device according to claim 1, wherein a maximum difference between said peripheral speed of the indirect-contact inking roller and said peripheral speed of said plate cylinder is 10%.

4. The offset printing device according to claim 1, wherein the inking rollers are driven at relative peripheral speeds in a differential gradient of at least 2% from one another in terms of peripheral speed.

5. The offset printing device according to claim 1, wherein the plate cylinder carries a dry flatbed printing plate for dry offset printing.

6. The offset printing device according to claim 1, wherein the plate cylinder carries a printing plate suitable for wet offset printing, the printing device further comprising a damping unit mounted upstream of the inking unit relative to a direction of rotation of the plate cylinder.

7. The offset printing device according to claim 1, wherein four of said ink application rollers are provided, and wherein two of said direct-contact rollers are provided, each one of said direct-contact rollers directly contacting a respective pair of said ink application rollers.

8. The offset printing device according to claim 1, wherein at least two of said indirect-contact rollers are provided.

9. The offset printing device according to claim 1, further comprising:

a plurality of intermediate ink transport rollers in rollable inking communication with the ink application rollers, the indirect-contact inking rollers being positioned in rolling contact among the transport rollers.

* * * * *